US006322227B1

(12) United States Patent
Liu et al.

(10) Patent No.: US 6,322,227 B1
(45) Date of Patent: Nov. 27, 2001

(54) CHEMILUMINESCENT LIGHTING DEVICE

(75) Inventors: Ker-Chuan Liu, Tainan; Kun-Chuan Cheng, Tainan Hsien, both of (TW)

(73) Assignee: Kai Gee Enterprise Co., Ltd., Tainan (TW)

( * ) Notice: Subject to any disclaimer, the term of this patent is extended or adjusted under 35 U.S.C. 154(b) by 0 days.

(21) Appl. No.: 09/695,071

(22) Filed: Oct. 25, 2000

(51) Int. Cl.[7] ..... F21K 2/00
(52) U.S. Cl. ..... 362/34; 362/101; 362/806
(58) Field of Search ..... 362/34, 101, 806

(56) References Cited

U.S. PATENT DOCUMENTS 5,508,893 * 4/1996 Nowak et al. ..... 362/34
5,552,968 * 9/1996 Ladyjensky ..... 362/34
5,609,409 * 3/1997 Diehl ..... 362/101
5,860,724 * 1/1999 Cheng ..... 362/34

* cited by examiner

*Primary Examiner*—Sandra O'Shea
*Assistant Examiner*—Guiyoung Lee
(74) *Attorney, Agent, or Firm*—Rosenberg, Klein & Lee

(57) ABSTRACT

A chemiluminescent lighting device having oxalate solution, several glass ampules, and a solution holding assembly including an outer holding part and an inner holding part. The inner holding part is passed into; and connected to, the outer holding part with a room between them. Each of he glass ampules contains activator solution and is fragile. The glass ampules and the oxalate solution are received in the room such that both can react to generate light when the upper holding part is depressed from a top side to break the glass ampules.

3 Claims, 4 Drawing Sheets

CHEMILUMINESCENT LIGHTING DEVICE

BACKGROUND OF THE INVENTION

Devices, which adopt chemical means to generate light, have been used for many years. Such chemiluminescent lighting devices can be used for many purposes, including novelty uses, for example, a glow necklace and a luminous stick used by the participants of a party or concert.

The present invention is aimed at developing a chemiluminescent lighting device which can be combined with a glass such that the glass can look more attractive with the bright color. Many methods have been used to make a party or a public house have happy atmosphere. The inventor of the present invention intends to device a glass with chemiluminescent lighting device, particularly for use in a pub, so as to make happy atmosphere.

SUMMARY OF THE INVENTION

It is a main object of the present invention to provide a chemiluminescent lighting device which can be easily attached to a glass and easily activated to generate light for the glass to look mole attractive.

The chemiluminescent lighting device has exalated solution, several glass ampules and a holding assembly. The holding assembly includes an outer holding part and an inner holding part passed into, and connected to the outer holding part. A room is formed between the inner and the outer holding parts.

The glass amplues each has a activator solution contained therein. The glass ampules are disposed in the room, and on a top of the inner holding part such that the glass ampules can be broken by means of depressing the outer holding part from a to thereof.

The oxalate solution is contained in the room such that same call react with the activator solution to generate light when the glass ampules are broken.

The chemiluminescent lighting device call be connected to a glass having a holding room by passing same into the holding room to make the glass look more attractive with its light.

BRIEF DESCRIPTION OF THE DRAWINGS

This invention will be better understood by referring to the accompanying drawings, wherein.

DESCRIPTION OF THE PREFERRED EMBODIMENTS

Figure 1:
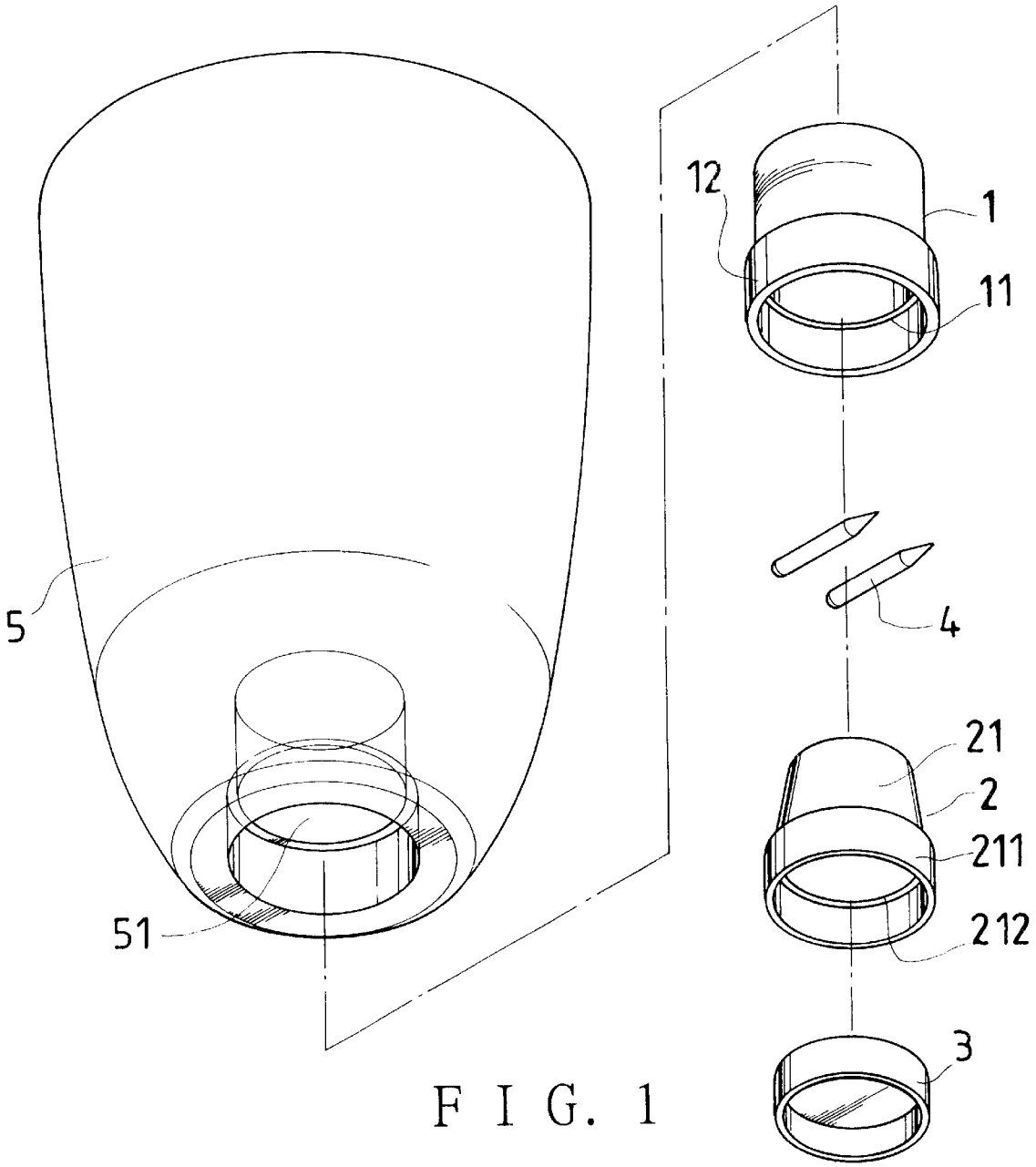
FIG. 1 is an exploded view of the chemiluminescent lighting device of the present invention.

Referring to FIG. 1, a chemiluminescent lighting device of the present invention includes an outer holding part 1, an inner holding part 2, a bottom covering 3, glass ampules 4 and oxalate solution (not shown).

The outer holding part 1 has an annular protrusion 11 on an inner side and a connecting rim 12 on an outer side.

Figure 2:
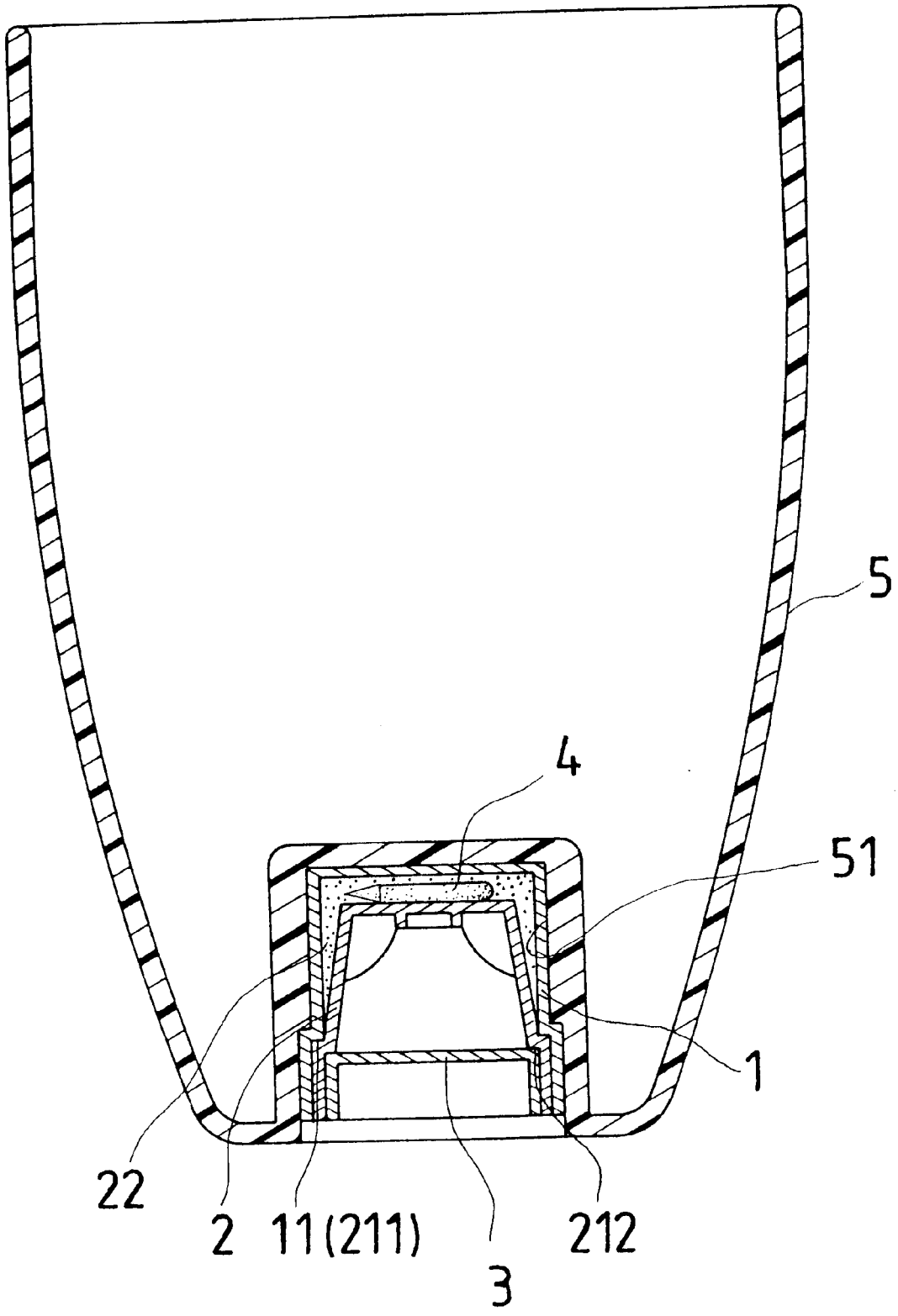
FIG. 2 is a cross-sectional view of the chemiluminescent lighting device of the present invention.

The inner holding part 2 has an upper confining part 21, an annular protrusion 212 on an inner side, a connecting rim 211 on an outer side. The inner holding part 2 is passed into the outer holding part 1 with the connecting rim 211 connected to the inner annular protrusion 11 of the outer holding part 1; ultrasonic welding can be used to connect the connecting rim 211 to the inner annular protrusion 11. There is a room between the upper confining part 21 of the inner holding part 2 and the outer holding part 1; the oxalate solution is held in the room, and the glass ampules 4 are disposed between the top side of the upper confining part 21 and the outer holding part 1 (as shown in FIG. 2). The glass ampules 4 each holds activator solution therein, and is fragile such that same can be broken easily for the activator solution to react with the oxalate solution to generate light when the outer holding part 1 is depressed from the top.

The bottom covering 3 is inserted into the inner holding part 2, and connected to the connecting rim 212 by means of ultrasonic welding.

A glass 5 to be combined with the chemiluminescent lighting device is provided. The glass 5 is transparent or semitransparent. The glass 5 has a holding room 51 having an upper part (not numbered) for holding an upper portion of the outer holding part 1, and a wider lower part (not numbered).

The chemiluminescent lighting device is passed into the holding room 51 of the glass 5. Thus, the lighting device can generate light to beautify the glass when the glass ampules 4 are broken by depressing the top of the outer holding part 1. The light can make the glass look attractive, especially when there are drinks held in the glass 5.

Figure 3:
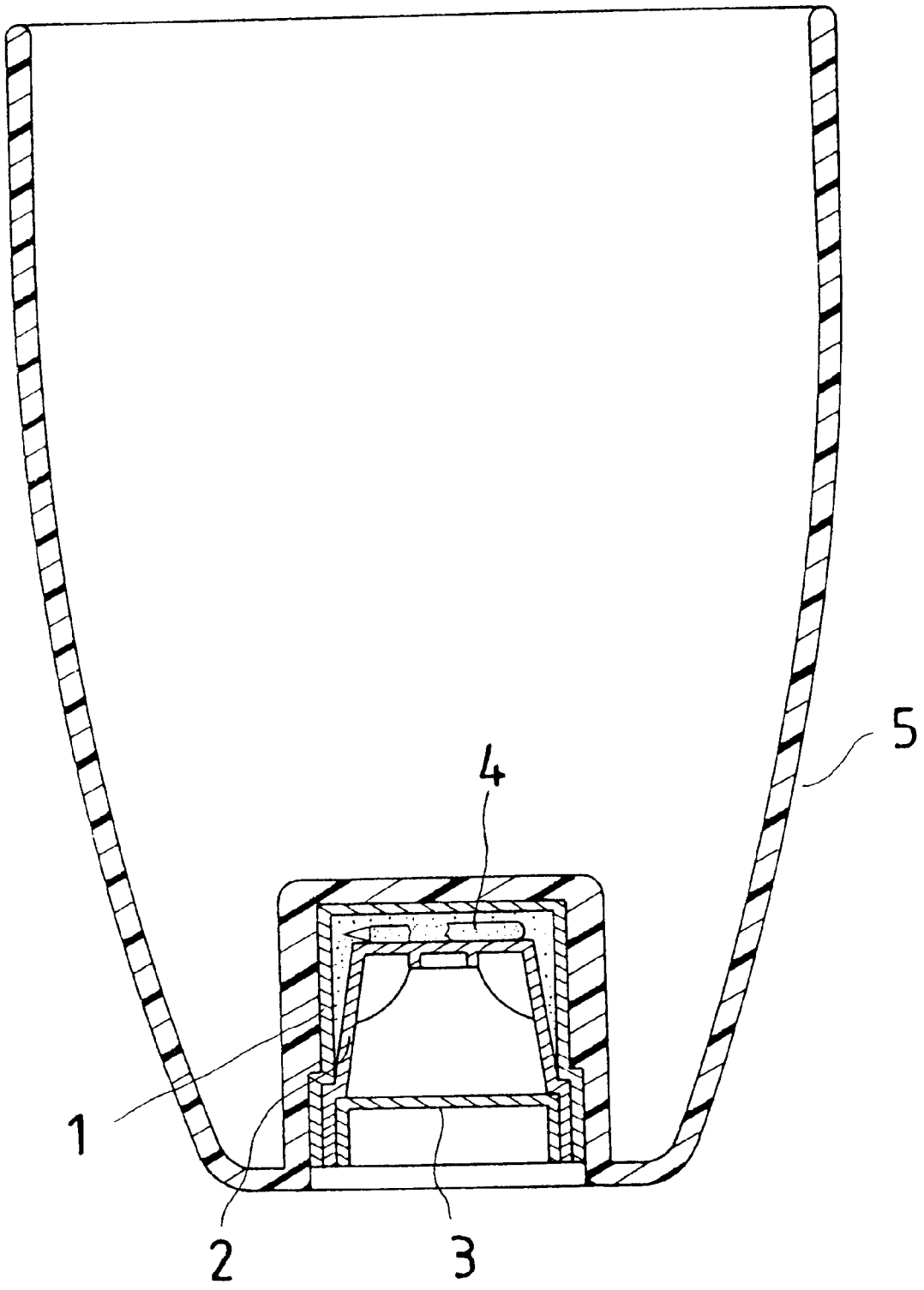
FIG. 3 is a cross-sectional view of the chemiluminescent lighting device of the present invention, with the glass ampules being broken to generate light.
Figure 4:
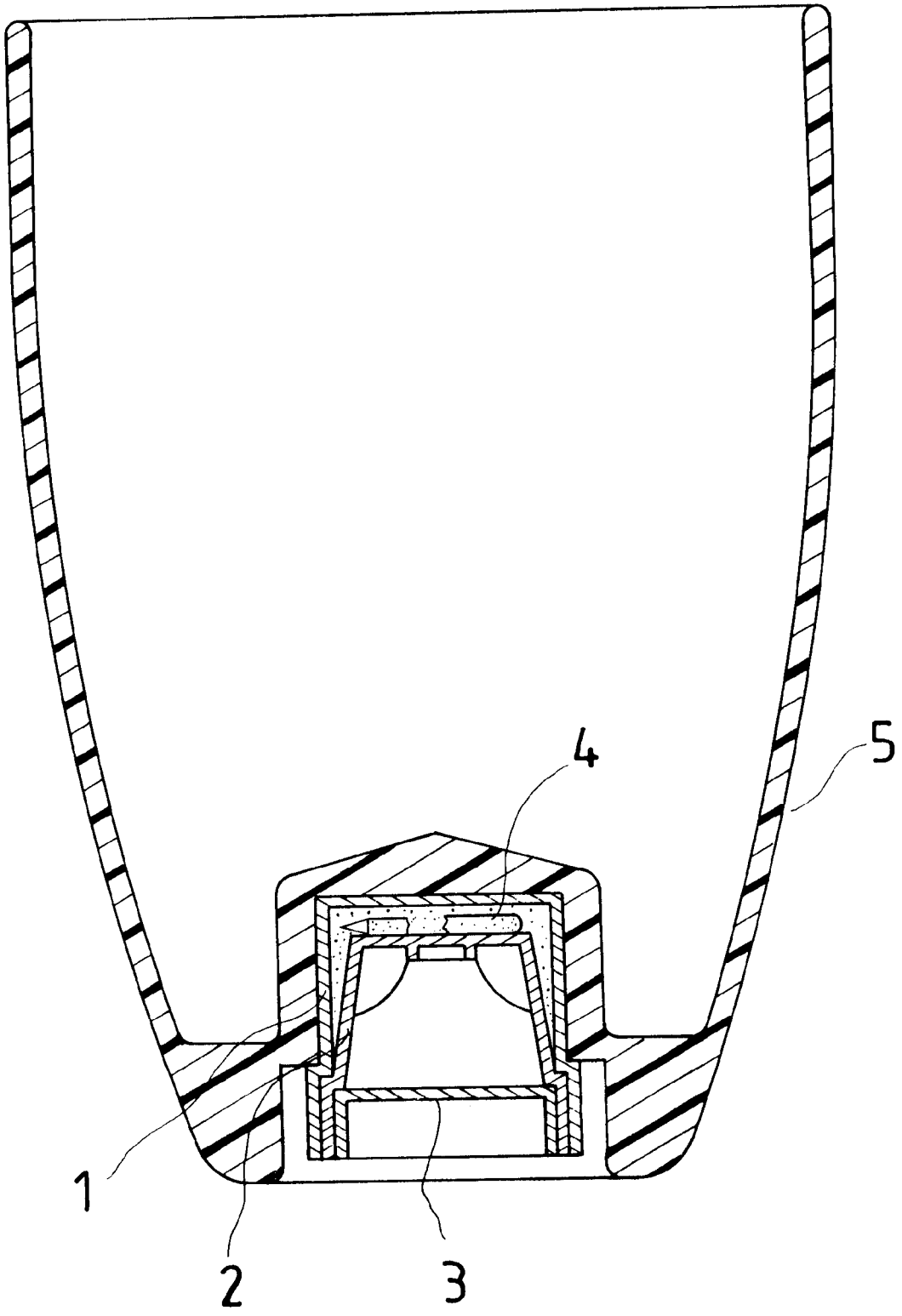
FIG. 4 is a cross-sectional view of the chemiluminescent lighting device according to the second embodiment of the present invention.

Referring to FIGS. 2 and 3, there is no space between the connecting rim 211 of the inner holding part 2 and the wider lower part of the holding room 51. Referring to FIG. 4 there is space between the connecting rim 211 and the lower part of the holding room 51 such that the lighting device can be easily removed from the glass 5, and replaced with a new one when it is used.

The lighting device of the present invention call also be used with ice carving to make same look more beautiful.

From the above description, the chemiluminescent lighting device of the present invention can be known to be able to make a glass look more attractive and be easily used.

What is claimed is:

1. A chemiluminescent device, comprising:

a drinking vessel having a cavity formed therein and extending to an upper end of said drinking vessel, said drinking vessel including a holding room formed therein, said holding room having a sidewall structure extending from an opening formed in a bottom of said drinking vessel into said cavity and terminating at an end wall of said holding room; and, a holding assembly received within said holding room of said drinking vessel, said holding assembly being contiguously enveloped by said end wall and said sidewall structure of said holding room, said holding assembly including:

an outer holding part having a receiving space formed therein and terminating in an end wall, said outer holding part having an outer contour corresponding to an inner contour of said holding room;

an inner holding part having an upper end portion and a sidewall structure extending from said upper end portion at the periphery thereof, said inner holding part being secured within said receiving space of said outer holding part, said upper end portion being spaced from said end wall of said outer holding part to define a chamber therebetween;

an oxalate solution filling said chamber; and a plurality of glass ampules, each containing an activator solution therein, said glass ampules being disposed in said chamber, said upper holding part being depressable to break said glass ampules, wherein upon breaking said glass ampules, said activator solution reacts with said oxalate solution to generate light to illuminate said cavity of said drinking vessel.

2. The chemiluminescent light device as claimed in claim 1, wherein said outer contour of said outer holding part is defined by a cylindrically shaped upper portion and a cylindrically shaped connecting rim below said upper portion, said connecting rim having a greater diameter than said cylindrically shaped upper portion, and wherein said sidewall structure of said inner holding part includes a connecting rim formed at a lower edge of said sidewall structure and adapted to sealingly engage a corresponding inner surface portion of said outer holding part.

3. The chemiluminescent lighting device as claimed in claim 2, wherein said connecting rim of said inner holding part surrounds an annular protrusion defined therein, said holding assembly further including a bottom covering secured in said annular protrusion of said inner holding part.

* * * * *